United States Patent [19]

Shoup

[11] 4,392,569

[45] Jul. 12, 1983

[54] SOFT CONTACT LENS ASEPTICIZING CASE

[76] Inventor: Leo E. Shoup, 125 N. Mt. Vernon St., Prescott, Ariz. 86301

[21] Appl. No.: 339,598

[22] Filed: Jan. 15, 1982

Related U.S. Application Data

[63] Continuation of Ser. No. 30,188, Jun. 6, 1979, abandoned.

[51] Int. Cl.[3] ..... B65D 85/00; B08B 3/10; B65D 85/38; A45C 11/04; A61F 9/00

[52] U.S. Cl. ..... 206/5.1; 206/205

[58] Field of Search ..... 206/5.1, 205

[56] References Cited

U.S. PATENT DOCUMENTS 3,298,502 1/1967 Schwartzman ..... 206/5.1

3,343,657 9/1967 Speshyock ..... 206/5.1

3,977,517 8/1976 Kadlecik et al. ..... 206/5.1

FOREIGN PATENT DOCUMENTS 62951 5/1975 Australia ..... 206/5.1

*Primary Examiner*—William T. Dixson, Jr.

*Attorney, Agent, or Firm*—Joseph H. Roediger

[57] ABSTRACT

An asepticizing case for the storage and transport of soft contact lenses wherein each lens is confined on a curved surface in a fluid environment without the direct application of force thereto. A flexible skirt having a smaller radius of curvature than that of the lens receiving surface is affixed to the cap to insure the positioning of each lens.

5 Claims, 4 Drawing Figures

SOFT CONTACT LENS ASEPTICIZING CASE

This application is a continuation of my co-pending U.S. patent application Ser. No. 06/030,188 having a filing date of June 6, 1979, now abandoned.

BACKGROUND OF THE INVENTION

This invention relates to devices for containing soft contact lenses during transport and storage.

The contact lens has gained wide acceptance as a replacement for conventional eyeglasses. Initially, contact lens were formed of hard material (hard lenses were often uncomfortable when worn by a significant number of users) thereby creating a need for soft lenses which more readily adapt to the geometric shape of the user. The hard lenses were stored in a variety of different containers some of which permitted them to be maintained in an asepticized environment. Since the lenses were rigid, they could be fixedly held against a curved receiving portion and stored for subsequent use.

One such device is shown in U.S. Pat. No. 3,298,502 to Schwartzman which positively urges a portion of the hard contact lens against a valve head to permit fluid flow within the container. FIG. 9 of the patent clearly shows the use of part of the lens to transmit force as the cap is rotated onto the threaded body. This device applies pressure to the lens, with the pressure being confined to a relatively small area of the lens and apparently rotates the lens while it is under pressure. This type of container is unsuitable for use with soft contact lenses wherein selective pressure results in dimensional change and the rotation under pressure is likely to scratch or otherwise damage the lens.

Another container for hard contact lenses is shown in U.S. Pat. No. 3,037,616 to Phipps wherein the hard lens is rotated on a carrier into position against a deformable pressure-exerting pad. The potential for scratching soft lenses is quite high with this type of device. Further, the device is not intended to permit the entire lens to be subject to the moistening of an aseptic fluid. This is likely to result in shrinkage of a soft lens during storage.

The U.S. Pat. No. 3,343,657 to Speshyock discloses separate baskets for each hard contact lens. Each basket is contained within a sealed container suitable for containing a fluid. In this device the lens is free to move within the basket as noted from FIG. 4 and is unsupported during storage. While unsupported, free-movement storage may be appropriate under normal conditions for hard lenses, a supporting surface and limited movement thereon is needed for soft contact lenses due to their ability to change shape when exposed to modest unbalanced forces and their susceptibility to scratching due to contact with semi-rigid materials such as utilized in this type of hard lens storage device.

A soft contact lens carrier is shown in West German Pat. No. 2,531,827 to Bausch & Lomb which is concerned with maintaining the soft lens moist during storage. This device utilizes positive pressure hold-down by means of a snap-fitted locking arm within the chamber. The device utilizes a number of different piece parts which have to be assembled for relative movement during normal operation, thereby increasing the cost to the user. This type of carrier requires the user to perform several steps in removing the lens. Further, the release of the snap-fit locking device appears likely to carry the lens from its customary location making it difficult to locate for the user. The support structure for the lens is located in the cap rather than in the body so that any dislodging of the lens due to the removal of the locking mechanism has a greater potential for loss of the lens than would otherwise be the case.

Accordingly, it is an object of the invention to provide a simplified storage container for soft contact lenses which does not exert positive pressure directly on the lens while permitting the aseptic fluid to contact the lens.

In addition, the invention provides a support surface for the lens with an overlying flexible skirt to maintain its position on the surface as the container is transported.

A further object is the provision of a soft lens container that does not require internal locking means and separate operations to position the lens therein. The invention is directed to reducing potential for damage to the lens or loss of the lens during the removal of the lens from the container.

Another object is to provide a main storage body from which the lens is taken directly while in contact with the fluid solution for insertion by the user.

SUMMARY OF THE INVENTION

The present invention is directed to a soft contact lens asepticizing case. The case includes a base member having central raised portions for each lens with a retaining wall member surrounding each central raised portion.

The wall member is greater in height than the enclose raised portion upon which the soft contact lens is to be stored. Then, in the upright position, the stored lens is continually contacted by the aseptic fluid. Sealing cap means is provided for each wall member to establish a fluid-tight contact therewith.

Each sealing cap is provided with means for permitting the attachment of flexible internal guide means thereto. The flexible guide means extends downwardly from the cap means toward the corresponding central raised portion of the base member to insure that the soft contact lens remains oriented on the raised portion. In normal use, the guide means does not exert substantial force against the lens. In addition, the guide means contains at least one fluid passage therein to permit the asepticizing fluid to contact the lens when it is stored on the raised portion. In operation, the internal guide means does not contact the lens itself but contacts the peripheral portion of the receiving surface for the lens to prevent significant movement thereof during storage.

Further features and advantages of the invention will become more readily apparent from the following detailed description of a specific embodiment of the invention when taken in conjunction with the accompanying drawings.

DETAILED DESCRIPTION OF A SPECIFIC EMBODIMENT

Figure 1:
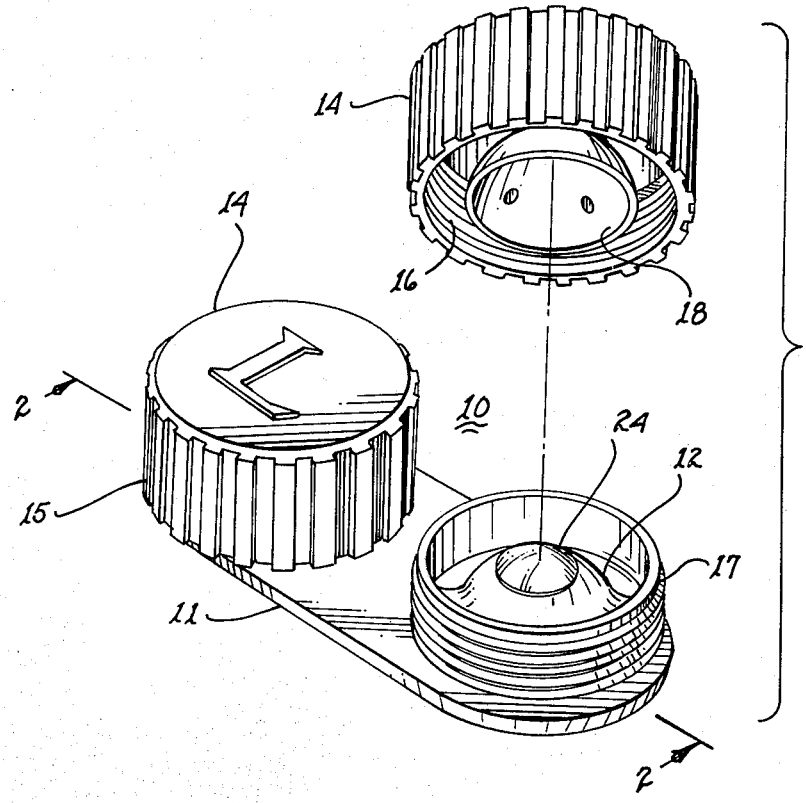
FIG. 1 is a view in perspective of one embodiment of the invention with a cap removed.
Figure 2:
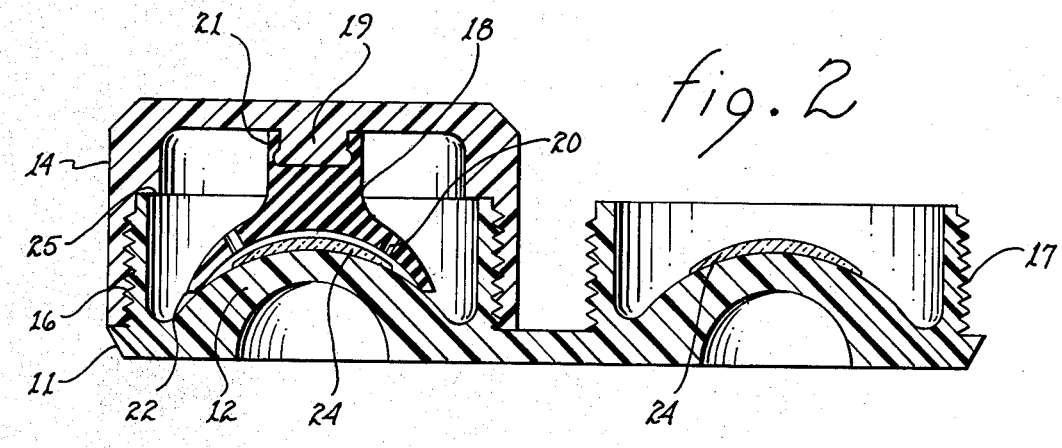
FIG. 2 is a side view in section taken along lines 2—2 of FIG. 1.

Referring now to FIGS. 1 and 2 of the drawings, a container for receiving and transporting a pair of soft contact lens in an aseptic solution is shown comprising an elongated base member 11 having two laterally spaced raised portions 12. In use, each raised portion is adapted for receiving a contact lens 24 placed thereon by the user.

A surrounding wall member 17 formed as an integral part of base member 11 is spaced adjacent each raised portion 12. Wall members 17 are provided with external threads as shown to receive the internal threads 16 of a cap 14 and establish a fluid tight sealing connection therebetween. As shown in FIG. 2, internal threads 16 end at inwardly-extending shoulder 25 which is utilized in other embodiments of the invention to provide a seat for an O-ring (not shown) and thus aid in forming a fluid-tight seal. The addition of a sealing member enables a wide range of materials to be utilized in the manufacture of the invention.

The reservoir formed by the base member 11, raised portion 12 and adjacent wall 17 is normally filled with an asepticizing solution to maintain the lens in a bacteria-free environment during periods of nonuse. The securing of caps 14 enables the lens to be readily transported while still being kept moist. The drying of a soft contact lens results in a dimensional change and should be avoided. In addition, the device can be placed in boiling water for sterilization.

In order to insure that each lens 24 is kept moist when stored as shown in FIGS. 1 and 2, the surrounding wall members 17 are formed to be substantially higher than the center of the raised portion 12. In practice, the walls are made twice as high so that fluid will be available to cover lens 24 when positioned on the lens receiving surface of portion 12.

Each cap is provided with a flexible skirt 18 attached by fastening means 19, typically a downwardly extending central member having a ridge at the lower portion. The skirt includes a tubular portion for receiving the central member and the combination of frictional force and the ridge retain the skirt on the cap. In the event replacement is required the user can readily remove the old skirt and attach a new one. The fit between skirt and cap is adjustable by the user by controlling the space, if any, between cap and skirt. This permits the user to exert control over how the lens is to be kept in position on the raised portions 12. As shown, the lower portion of the skirt is hemispherical to accommodate the lens 24 and the raised portion 12 therein. The peripheral portion 22 of the skirt contacts the adjacent portion of the raised portion 12 and base member 11 when the cap is fastened to the threaded walls. The amount of contact can be varied by movement of the skirt 18 on the fastening means 19.

It should be noted from FIG. 2 that the radius of curvature of raised portions 12 is greater than the radius of curvature of skirt 18 thereby enabling the peripheral portion of the skirt to act as a retainer for the positioned lens 24 without contacting the lens itself. In the event that the skirt should undergo shrinkage with long periods of use, the position of the skirt on the fastening means 19 can be adjusted to provide the retaining function without direct contact of the lens.

Figure 3:
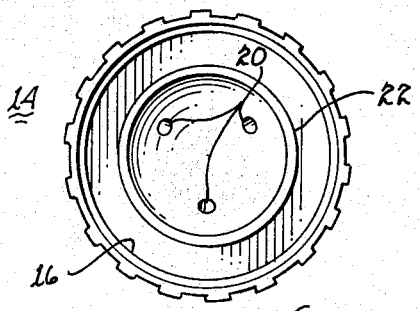
FIG. 3 is a view of underside of the cap in the embodiment of FIG. 1.
Figure 4:
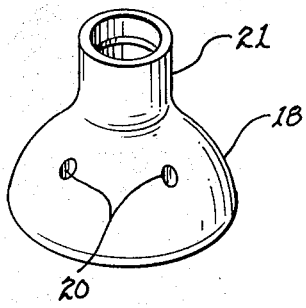
FIG. 4 is a perspective view of the flexible skirt shown within the cap of FIG. 3.

Ports 20 are provided in the skirt to permit fluid communication therethrough and therefore enable the retained lenses to be continually moistened by the asepticizing solution. The skirt 18 is shown in greater detail in FIG. 4 with three fluid flow paths 20 extending therethrough. The bottom view of FIG. 3 wherein the skirt is shown attached to the skirt 14 shows the diameter of the cap to be approximately one-half of the diameter of the cap. This relationship is dependent in part on the width of the region within the wall 17 and adjacent to the raised portion 12. It is desirable to provide an adjacent region of significent width to contain a portion of the fluid below the central region of the raised portion where the lens is to be positioned. This aids in the moisturizing of the lens during storage and transport.

In use, the wearer of a soft contact lens unfastens the appropriate cap 14, typically coded with an R or L, removes the lens 24 from his eye and places it concave surface downward on the center of the raised portion and adds an aseptic solution such as saline solution to the reservoir formed by the base member and the enclosure wall. Sufficient fluid is added to at least cover the lens and then the cap is secured to the wall thereby placing the peripheral portion 22 of the skirt in contact with the inner region of the base member adjacent to the raised portion thus retaining the lens thereon without directly contacting the soft lens thereby essentially eliminating the risk of surface damage to the lens. Lens movement is limited and the lens is maintained in contact with the fluid due to the presence of the ports in the skirt. Thus storage is provided in a manner which enables a lens to be reinserted by the user without requiring the lens to be restored to original size by presoaking.

The foregoing description refers to a soft contact lens case which includes only five parts, and is thus readily manufactured and straight forward to use. The lens is maintained in contact with the fluid, restrained but not clamped, until withdrawn by the user. It is recognized that variations and modifications may be made in connection with this description of a preferred embodiment without departing from the scope of the invention as claimed.

I claim:

1. A soft contact lens asepticizing case comprising:

(a) a base member having a surface containing two spaced central raised portions for receiving a contact lens thereon and an upstanding wall member surrounding each said central portion, said wall member having a height greater than the height of said central portion whereby the addition of fluid to said base member enables the central portion to be covered with fluid;

(b) sealing cap means for engaging each wall member and establishing a fluid-tight contact therewith;

(c) means contained on each sealing cap means for permitting the attachment of an internal guide thereto; and (d) flexible internal guide means for attachment to each of said cap means, said guide means extending downwardly from said cap means to each central raised portion of said base member for maintaining a soft contact lens thereon, said guide means being spaced from said lens and containing at least one fluid passage therein to permit fluid to contact said lens.

2. The asepticizing case of claim 1 wherein each central raised portion of said base member is a raised dome having a curved central surface for receiving a contact lens thereon, the raised dome having a first radius of curvature.

3. The asepticizing case of claim 2 wherein each flexible internal guide means has a skirt portion adapted for contact with the peripheral portion of a raised dome, said skirt portion being spaced from the central portion of the dome when the sealing cap means engages the retaining wall.

4. The asepticizing case of claim 3 wherein the skirt portion of said guide means is curved having a second radius of curvature, said first radius being greater than said second radius to permit retention of the lens on the central portion of said dome without contact by said guide means.

5. The asepticizing case of claim 4 wherein the height of said upstanding wall member is substantially greater than the height of said central portion.

* * * * *